US007007936B2

(12) United States Patent
Chang

(10) Patent No.: US 7,007,936 B2
(45) Date of Patent: Mar. 7, 2006

(54) SPRING CLAMP

(76) Inventor: Ching-Tsung Chang, No. 60, Alley 215, Cheng Feng Lane, Tai Ming Rd., Wu Jih, Taichung (TW)

( * ) Notice: Subject to any disclaimer, the term of this patent is extended or adjusted under 35 U.S.C. 154(b) by 124 days.

(21) Appl. No.: 10/680,251

(22) Filed: Oct. 8, 2003

(65) Prior Publication Data

US 2005/0077666 A1 Apr. 14, 2005

(51) Int. Cl.
*B66F 3/00* (2006.01)

(52) U.S. Cl. ..... 269/6; 81/319

(58) Field of Classification Search ..... 81/318–321, 81/323–325; 269/6
See application file for complete search history.

(56) References Cited

U.S. PATENT DOCUMENTS 1,772,428 A * 8/1930 Palotce ..... 81/319

* cited by examiner

*Primary Examiner*—Robert C. Watson
(74) *Attorney, Agent, or Firm*—Troxell Law Office, PLLC

(57) ABSTRACT

A spring clamp has an elastically operable locating mechanism provided between two handles of the spring clamp, so that the two handles may instantaneously enter into a firmly braked position when the spring clamp clamps work pieces thereto, and immediately released from the braked position when a push button of the locating mechanism is pushed. The spring clamp with the elastically operable locating mechanism is more convenient for use without the risk of unexpectedly loosening from work pieces clamped thereto.

8 Claims, 6 Drawing Sheets

SPRING CLAMP

FIELD OF THE INVENTION

The present invention relates to a spring clamp, and more particularly to a spring clamp having an elastically operable locating mechanism provided between two handles of the spring clamp, so that the spring clamp would not unexpectedly skid off or loosen from clamped work pieces in the process of machining the work pieces.

BACKGROUND OF THE INVENTION

A spring clamp is mainly used to firmly and tightly clamp two work pieces together to facilitate subsequent fabricating or machining of the work pieces. For example, two planks may be clamped together using the spring clamp and then drilled or cut. Most of the currently available spring clamps do not have any auxiliary locating mechanism provided on or between two handles thereof, and are subject to unexpected loosening from the work pieces clamped between two jaws of the spring clamps due to an overlarge vibration produced during drilling or cutting the work pieces. The conventional spring clamps therefore have adverse influences on machining quality and efficiency.

To overcome the above-mentioned problem, there has been developed an auxiliary locating mechanism for mounting between two handles 11, 12 of the spring clamp, as shown in FIG. 9. However, the auxiliary locating mechanism has a control lever that occupies a considerably large space. Moreover, the control lever is fixed at a proximal end to the auxiliary locating mechanism with rivets or screws and nuts. Since the space between the two handles 11, 12 of the spring clamp is small, it is uneasy and therefore time-consuming to assemble the control lever to the auxiliary locating mechanism in the above manner. The spring clamp with the conventional auxiliary locating mechanism therefore requires relatively high manufacturing cost while the productivity thereof is low.

It is therefore tried by the inventor to develop a spring clamp having an elastically operable locating mechanism that is structurally simple and compact, functionally improved and practical for use, as compared with the conventional auxiliary locating mechanism.

SUMMARY OF THE INVENTION

A primary object of the present invention is to provide an elastically operable locating mechanism for a spring clamp, so that two handles of the spring clamp may instantaneously enter into a firmly braked position when the spring clamp clamps work pieces thereto, and immediately released from the braked position when a push button of the elastically operable locating mechanism is pushed.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
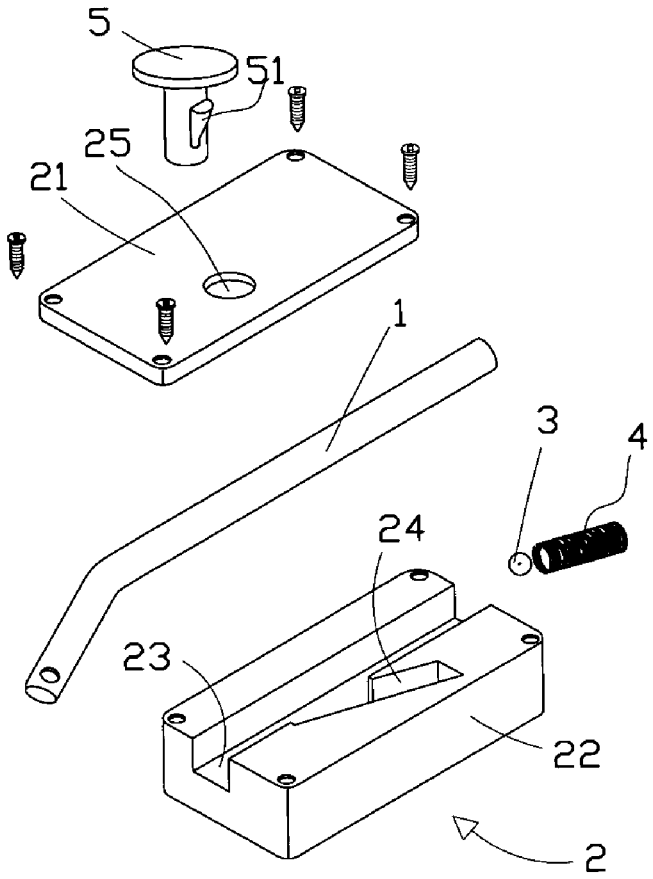
FIG. 1 is an exploded perspective view of an elastically operable locating mechanism for a spring clamp according to the present invention.
Figure 2:
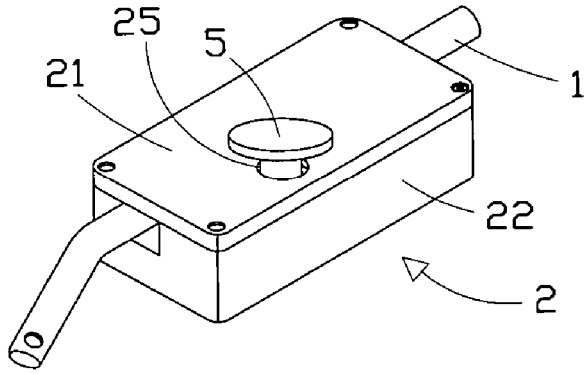
FIG. 2 is an assembled perspective view of the elastically operable locating mechanism FIG. 1.
Figure 3:
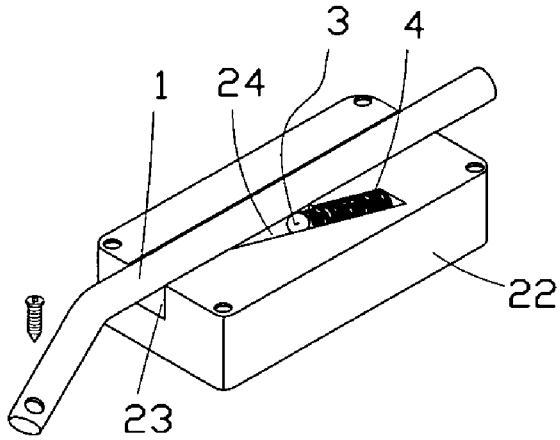
FIG. 3 is similar to FIG. 2 with a top cover removed therefrom to better show the arrangement of related components of the elastically operable locating mechanism.
Figure 4:
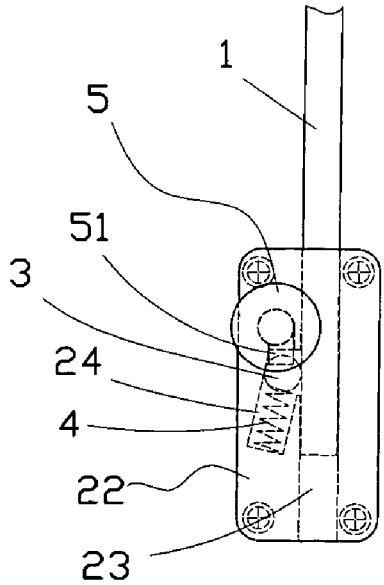
FIG. 4 is a top plan view showing the arrangement of related components of the elastically operable locating mechanism of FIG. 2.

Please refer to FIGS. 1 to 4 in which an elastically operable locating mechanism for a spring clamp according to the present invention is shown. As shown, the elastically operable locating mechanism mainly includes a pull bar 1, a housing 2, a steel ball 3, a compression spring 4, and a push button 5.

The housing 2 is divided into a seat 22 and a top cover 21 screwed to the seat 22. The seat 22 is provided at a top with a first groove 23 extended in parallel with two longitudinal sides of the seat 22, and a second groove 24 obliquely extended from one side of the first groove 23 at a predetermined angle. The seat 22 is provided near a lower dead point of the second groove 24 with a vertical bore 25 having a predetermined depth, and the top cover 21 is provided with a through hole corresponding to the vertical bore 25. The pull bar 1 is slidably set in the first groove 23 on the seat 22, and the steel ball 3 and the compression spring 4 are sequentially positioned in the second groove 24 so that the steel ball 3 is normally pushed forward by the compression spring 4. Since the second groove 24 is obliquely extended from one side of the first groove 23, and the steel ball 3 is normally pushed forward by the compression spring 4, a first portion of an outer surface of the steel ball 3 will bear against the pull bar 1 at a joint of the first groove 23 and the second groove 24.

The push button 5 includes an expanded head and a downward extended stem, and the stem is extended through the through hole 25 on the top cover 21 to mount in the vertical bore 25 on the housing 2. A projection 51 having a beveled lower surface is provided on the stem of the push button 5 to normally contact with a second portion of the outer surface of the steel ball 3.

Figure 5:
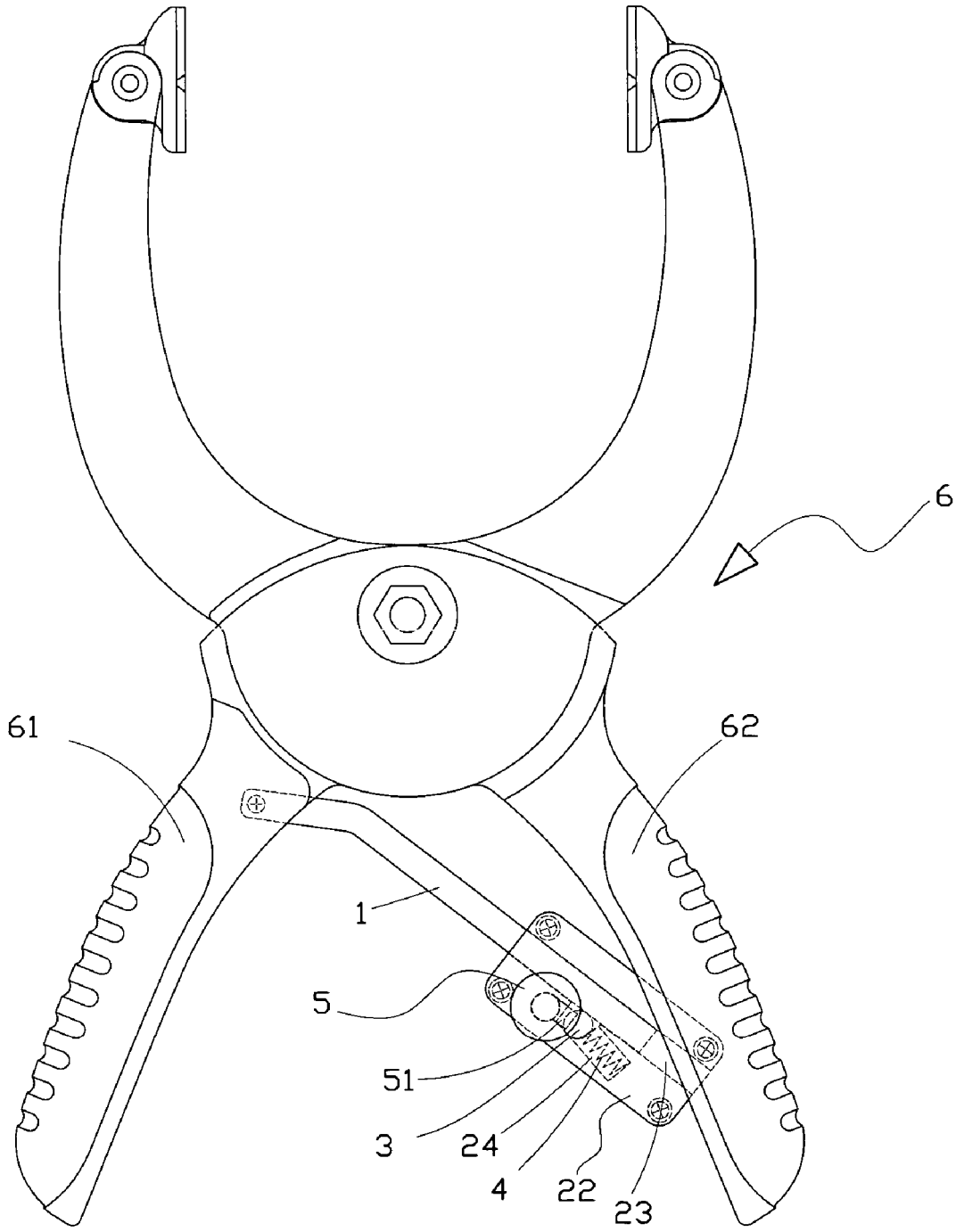
FIG. 5 shows the manner of mounting the elastically operable locating mechanism of FIG. 2 to two handles of a spring clamp.
Figure 6:
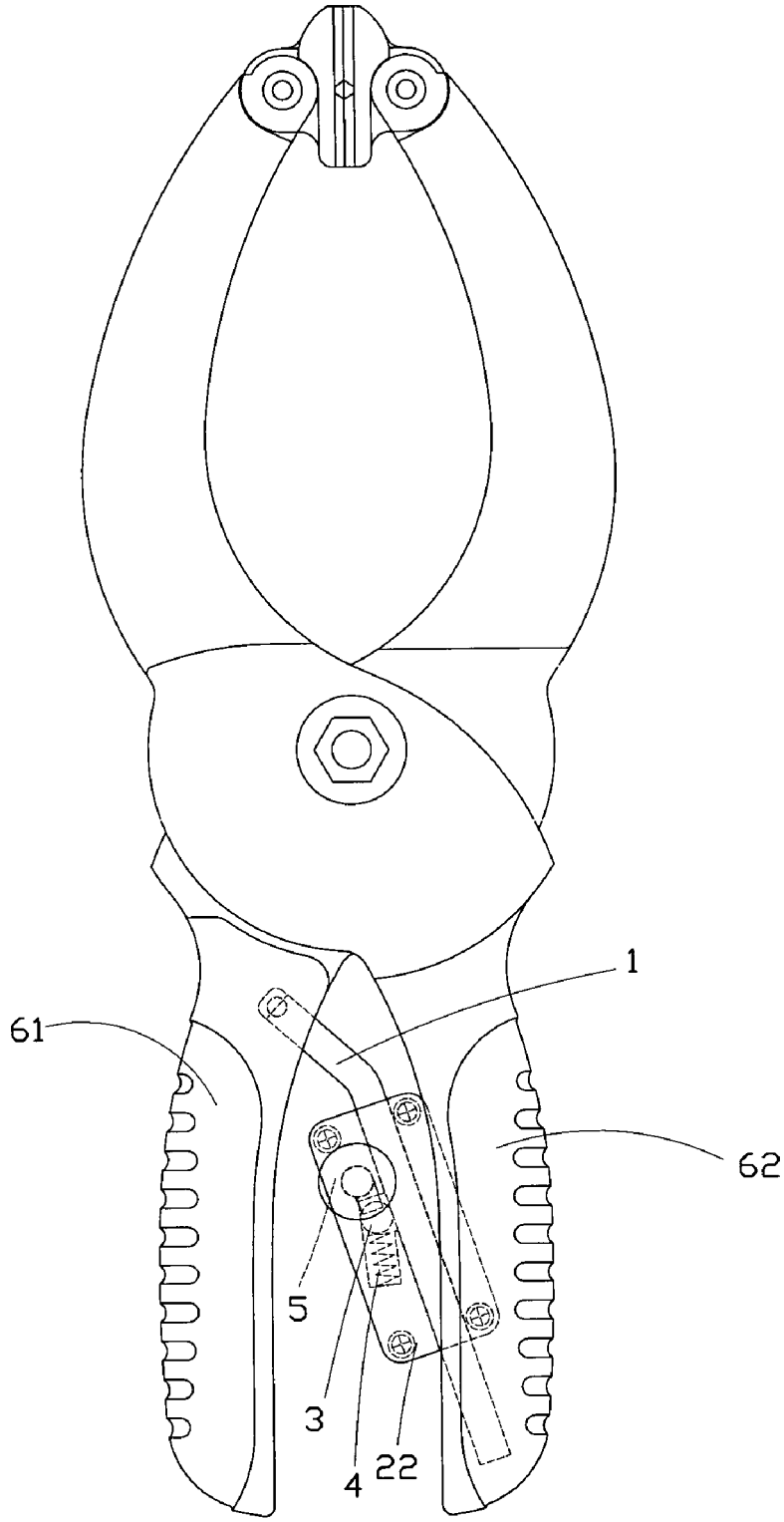
FIG. 6 shows the state of the elastically operable locating mechanism of FIG. 2 when the two handles of the spring clamp of FIG. 5 are fully pushed toward each other.

Please refer to FIG. 5. The elastically operable locating mechanism of the present invention is mounted between two handles 61, 62 of a spring clamp 6 by screwing a distal end of the pull bar 1 to a predetermined point on the first handle 61 and an end of the housing 2 opposite to the distal end of the pull bar 1 to a predetermined point on the second handle 62. When the first handle 61 is pivotally pulled toward the second handle 62 for the spring clamp 6 to tightly clamp two work pieces (not shown) together, as shown in FIG. 6, the pull bar 1 is synchronously pushed to slide in the first groove 23 on the seat 22 toward the second handle 62 and push the steel ball 3 into the second groove 24. When the pull bar 1 stops sliding toward the second handle 62, the steel ball 3 is pushed forward by the compression spring 4 to tightly press against the pull bar 1, the beveled projection 51 of the push button 5, and the joint of the first and the second groove 23, 24, preventing the pull bar 1 from sliding reversely toward the first handle 61. That is, the forward pushed steel ball 3 functions like a brake to stop the pull bar 1 from moving. And, since the pull bar 1 and the housing 2 are separately screwed to the two handles 61, 62 of the spring clamp 6, the braked pull bar 1 would immediately causes the two handles 61, 62 to stay in a braked state.

Figure 7:
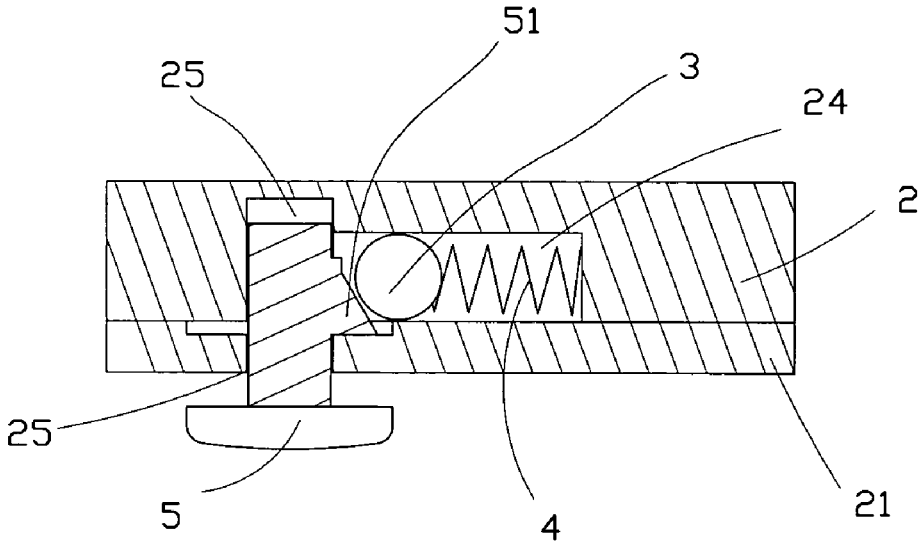
FIGS. 7 and 8 are sectional views showing the manner in which the elastically operable locating mechanism of the present invention operates.
Figure 8:
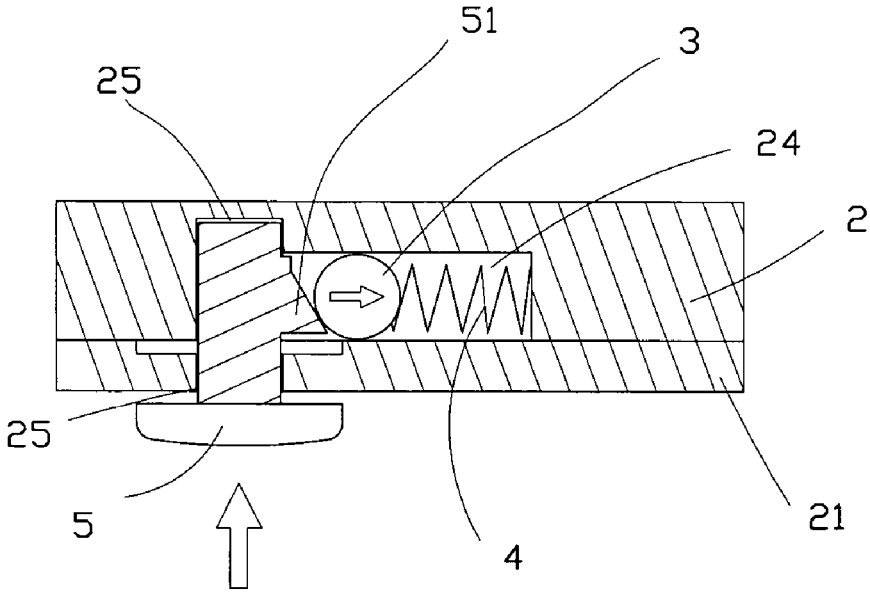
Figure 9:
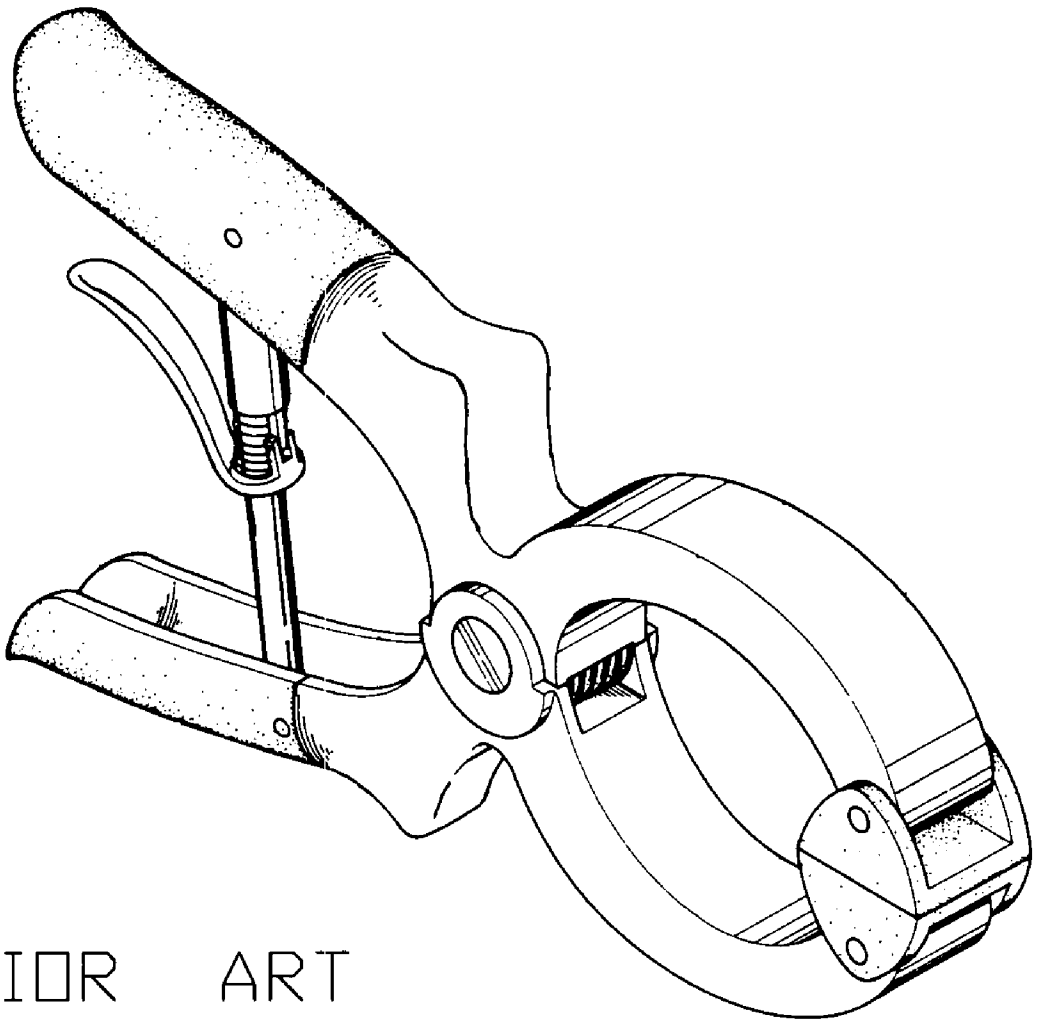
FIG 9 PRIOR ART
FIG. 9 is a perspective view of a spring clamp with a conventional auxiliary locating mechanism.

To release the two handles 61, 62 from the braked state, simply push the push button 5 projected from the top cover 21 of the housing 2, as shown in FIGS. 7 and 8, and the beveled lower surface of the projection 51 would push the steel ball 3 backward, so that the steel ball 3 leaves the lower dead point of the second groove 24 and separates from the pull bar 1 and the joint of the first and the second groove 23, 24. That is, the two handles 61, 62 of the spring clamp 6 are released from the braked state. The elastically operable locating mechanism for spring clamp according to the present invention is therefore very easy for use.

What is claimed is:

1. A spring clamp comprising:

a) first and second handles; and b) a locating mechanism having:

i) a housing pivotally connected to the first handle and having a first groove and a second groove communicating with the first groove;

ii) a pull bar slidably located in the first groove of the housing and pivotally connected at an end thereof to the second handle;

iii) a locking mechanism located in the second groove of the housing and selectively locking the pull bar in a predetermined position within the housing; and iv) a push button selectively moving the locking mechanism between a locked position engaging the pull rod and an unlocked position spaced apart from the pull rod.

2. The spring clamp according to claim 1, wherein the locking mechanism having a steel ball, and a compression spring pressing the steel ball toward the pull bar, the push button controlling the steel ball.

3. The spring clamp according to claim 2, wherein when the locking mechanism is located in the locked position the steel ball engaging the pull bar and an interior wall of the second groove locking the pull bar in the predetermined position, and when the locking mechanism is located in the unlocked position the push button separates the steel ball from the pull bar allowing the pull bar to slide within the first groove.

4. The spring clamp according to claim 1, wherein the housing having a vertical bore located in the second groove, the push button is located in the vertical bore.

5. The spring clamp according to claim 1, wherein the push button includes a projection located in the second groove and selectively engaging the steel bar.

6. The spring clamp according to claim 1, wherein the projection includes a beveled lower surface.

7. The spring clamp according to claim 1, wherein the housing having a seat and a top cover.

8. The spring clamp according to claim 7, wherein the first groove and the second groove are located in the seat, and the vertical bore extends through the top cover and into the seat.

* * * * *